United States Patent [19]

Fray et al.

[11] Patent Number: 4,857,156

[45] Date of Patent: Aug. 15, 1989

[54] SEPARATING A FERRO ALLOY

[75] Inventors: Derek J. Fray; Alan J. Godsell, both of Cambridge, England

[73] Assignee: National Research Development Corporation, London, England

[21] Appl. No.: 125,285

[22] Filed: Nov. 25, 1987

[30] Foreign Application Priority Data

Nov. 25, 1986 [GB] United Kingdom ..... 8628136
Feb. 18, 1987 [GB] United Kingdom ..... 8703697

[51] Int. Cl.[4] ..... C25C 3/00; C25C 3/04; C25C 3/26; C25C 3/30

[52] U.S. Cl. ..... 204/64 R; 204/64 T; 204/70; 204/71; 204/140; 204/67; 204/284; 75/63

[58] Field of Search ..... 75/63; 204/64 R, 64 T, 204/140, 67, 243 R-245, 70, 71, 284

[56] References Cited

U.S. PATENT DOCUMENTS

| | | | |
|---|---|---|---|
| 3,323,908 | 6/1967 | Tezuka | 75/63 |
| 3,677,926 | 7/1972 | Davis | 204/243 R |
| 4,118,292 | 10/1978 | Fray et al. | 204/64 T X |
| 4,288,246 | 9/1981 | Banski et al. | 75/63 X |
| 4,613,414 | 9/1986 | Sivilotti et al. | 204/284 X |
| 4,707,239 | 11/1987 | Murphy et al. | 204/284 X |

FOREIGN PATENT DOCUMENTS

| | | | |
|---|---|---|---|
| 3126940 | 3/1983 | Fed. Rep. of Germany | 204/243 R |
| 1515216 | 6/1978 | United Kingdom . | |

*Primary Examiner*—Donald R. Valentine
*Attorney, Agent, or Firm*—Cushman, Darby & Cushman

[57] ABSTRACT

Powdered FeMn alloy is leached with liquid bismuth, which alloys preferentially with the manganese to form liquid BiMn alloy, leaving behind iron powder. The BiMn is then electrorefined; an anode 1 selectively ionises the manganese, which is carried to the cathode 3 where it is reduced to the metal and collected in a stream of molten aluminium as AlMn master alloy.

16 Claims, 1 Drawing Sheet

SEPARATING A FERRO ALLOY

Figure 1:
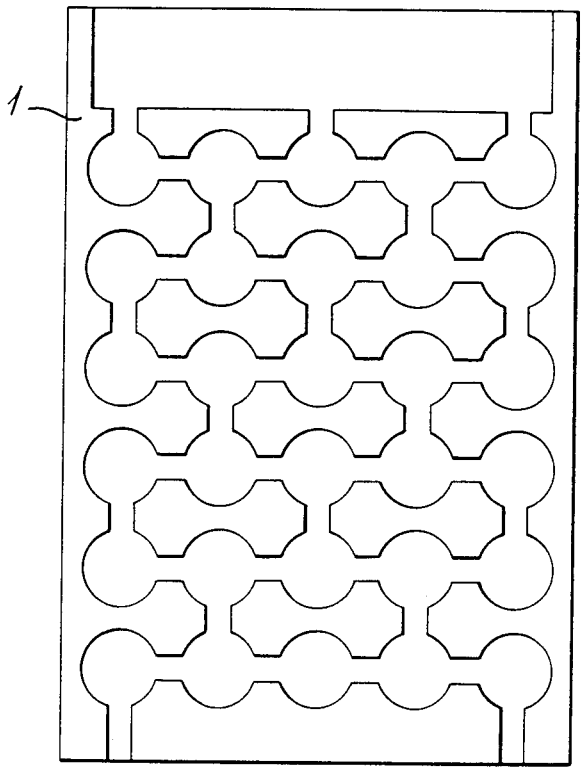

This invention relates to a method of electrorefining metals using metallic solvents.

A known packed bed cell for electrorefining metals is described in UK Patent Specification No. 1515216, and comprises an anode compartment containing a bed of conductive particles in a salt which is molten or in a conductive solution, means for passing a stream of molten metal or molten salt or salt in a conductive solution into the bed, a diaphragm of which one side (at least in part) bounds the anode compartment, a cathode compartment containing a bed of conductive particles in a salt which is molten or in a conductive solution on the other side of the diaphragm, which is pervious to the salt(s) but not to the molten metal. The cathode compartment may have means for passing a stream of molten metal through the bed. The anode compartment may have means for recirculating the liquid passed into and through it.

The diaphragm is saturated with the salt and, although preventing mixing of molten metal from opposite sides thereof, it is pervious to the salt and thus does allow metal ions to move through freely. The conductive particles may for example be granules of carbon or of titanium diboride; even metal particles can be used if unattacked by the salt(s) or the metal being refined and its contaminant(s). The salt is preferably a halide, (usually these are cheaper), e.g. zinc chloride or aluminum chloride, either possibly including as impurities or diluents up to 95% of sodium chloride and/or potassium chloride and/or lithium chloride. The salt advantageously is or includes a salt of the metal to be refined. Although the salt at the anode most conveniently has the same composition as that at the cathode, this is not essential. The metal may be zinc including as impurities for example aluminium, lead, cadmium, copper, tin and/or iron. Such a combination of impurities may arise when recovering zinc from scrap diecastings. The metal may alternatively be aluminium, which may include as impurities such metals as zinc, tin, lead, copper and/or gold.

An alternative electrode for use in electrowinning or electrorefining of metals comprises an electronically conductive block in one face of which are formed channels of varying crosssection and direction. The channels may interconnect, i.e. may form a network. the block may be of any inert electronically conducting material, such as carbon.

The diaphragm may be a fibrous ceramic fabric impervious to molten metal but pervious to metal ions, and may be sandwiched between a first and a second electrode as set forth above. The second electrode's channels may be substantially a mirror-image of, and in registry with, the first electrode, or the second electrode could have a plane surface facing the diaphragm, in which case some second-electrode/diaphragm spacing is advisable, so that any material electrodeposited on the second electrode will not pierce the diaphragm. As the diaphragm cannot, as a practical matter, be relied upon to remain so taut that this spacing is always accurately assured, the face of the electrode may be insulated and hence the diaphragm protected by a mica sheet cut out to fit the face of the electrode, i.e. reveal its channels.

The utility of the cell extends to a method of refining comprising passing a stream of molten metal through the channels of the first electrode in the presence of a molten salt or salt in a conductive solution saturating the diaphragm, and making the first electrode anodic with respect to the second electrode, and recovering the refined metal(s) which appear in the cathode channels.

Therefore according to the present invention, a method of separating a ferro alloy (Preferably a transition metal ferro alloy such as ferromanganese) comprises leaching the alloy (preferably in powder form) with a substance, normally a liquid metal such as bismuth, which alloys preferentially with the non-ferrous metal, the temperature being above the melting point of the preferentially formed alloy but below the melting point of iron, whereby the iron remains or precipitates as a solid. Preferably, the molten non-ferrous alloy is then treated, for example by electrorefining, to isolate the said substance (e.g. bismuth); conveniently this treatment is performed in a cell as set forth above, the said nonferrous alloy being passed through the anode channels and molten aluminium preferably being present at the cathode; cells according to UK Specification No. 1515216, for example, could be used instead.

Said substance should be used below its boiling point which, it should be noted in the case of bismuth, is below the melting point of some transition metal ferro alloys. Also according to the present invention, a method of refining a solute in bismuth or antimony, such as titanium or manganese, or magnesium or chromium or vanadium respectively, comprises making the molten solution anodic with respect to an electrowinning cathode separated from said solution by a diaphram pervious to solute cations. By way of exemplary elucidation of this latter case, though when dissolved in bismuth or antimony, titanium or magnesium has a reduced activity, this has only a small effect on the cell potential as the potential is related logarithmically to the activity via the equation $$-ZEF = RT\ln a$$

Iron co-dissolved with chromium in an antimony solvent will be left behind in the anode after the chromium has been electrorefined into the cathode, and this iron can then be removed from the antimony solvent by oxidation.

Titanium is generally very difficult to electrowin due to the fact that direct electrowinning of a salt such as titanium tetrachloride in a melt makes it very difficult to control the valency of the ions whereas electrorefining gives far greater flexibility in the selection of the electrolyte and, secondly, allows creation of the reduced titanium species, which are desirable for the production of a coherent deposit. Compared with other attempts at electrowinning from $TiO_2$ this route overcomes the problem of oxygen contamination in the titanium product by separating the usual electroleaching step (not described) from the electrowinning step. Secondly, again, by separating the two stages, the use of chloride electrolyte in the non-described leaching step does not preclude electrorefining in another non-chloride electrolyte which gives a more satisfactory deposit.

Figure 2:
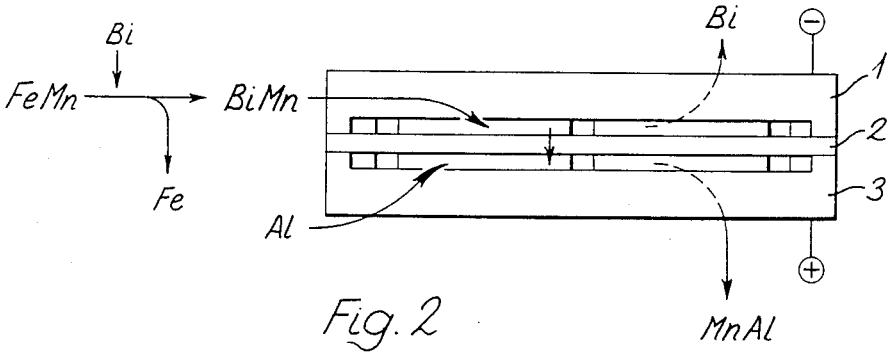

The invention will now be described by way of example with reference to the accompanying drawings, in which:

FIG. 1 is an end elevation of an electrode which may be used in a method according to the invention, and FIG. 2 is a schematic plan of a cell being used in a re-fining scheme according to the invention.

Turning to FIG. 1, a cuboidal graphite block 150 mm high×100 mm wide×30 mm thick has a network of channels machined out to a depth of 3 mm on one face. The channels consist of short narrow straight elements running between wider cylindrical elements. The channels are at 20 mm centres, the straight sections being about 5 mm wide and 5 mm long, the cylindrical elements being 15 mm in diameter.

In FIG. 2, as seen in plan, the block of FIG. 1 acts as an anode 1. A mirror-image block of graphite acting as a cathode 3 is mounted in registry with the anode. the two electrodes clamping a diaphragm 2. The diaphragm 2 is a fibrous ceramic fabric consisting of aluminosilicate or silica fibres felted or spun and woven to form a material e.g. Fiberfrax PH (Carborundum Co.) or Triton Kaowool (available from Morganite) in half-inch or one-inch thickness, or Refrasil (Chemical & Insulating Co. of Darlington (Darchem Group)) one-tenth of an inch thick. The diaphragm is normally an insulator but when saturated with electrolyte (as will be described) can transport current in the form of ions.

In use, in one application, ferromanganese is to be separated into iron and manganese, the manganese being recovered in the form of aluminium-manganese master alloy. First, liquid bismuth is added at about 100C. This preferentially alloys with (leaches out) the manganese, and the iron is left behind, or, if the ferro alloy is molten (unlikely unless the manganese content exceeds 70%), the iron precipitates and is removed. (High carbon in the ferro alloy, however, lessens this leaching ability of the bismuth.) The molten bismuth-manganese alloy is supplied to the top of the anode 1 and is allowed to trickle down the channels. The diaphragm 2 is impervious to the molten alloy, but is saturated with molten sodium chloride - potassium chloride manganous chloride electrolyte. The labyrinthine configuration of the channels allows the metal to flow through the pools of alloy and molten salt held in the electrode surface.

The cathode 3 contains molten electrolyte including sodium chloride in its channels and molten aluminium is trickled through its channels. The electrolytic action of anode and cathode selectively oxidises the manganese contained in the BiMn alloy at the anode, and this manganese is ionically transported across the diaphragm 2 to the cathode 3, where it is reduced to elemental manganese, which is collected by dissolution in the aluminium as it trickles down the cathode channels. The aluminum supplied directly to the cathode assists physically the collection of the cathodically deposited manganese, whose melting point without the presence of the aluminium would be impracticably high.

The shallowness of the channels and their labyrinthine course have the advantage that no large head of liquid metal builds up anywhere to stress the diaphragm 2. The diaphragm, traditionally a troublesome component of any cell, should therefore have a better chance of a long reliable service life.

The short anode-cathode distance keeps cell resistive losses to a minimum and also allows closer control over the actual voltage applied, local variations due to the thickness of the cell being kept relatively minor by the geometry and construction (especially the narrow anode/cathode spacing) of the cell according to the invention.

Analogous to the separation of BiMn other ferro alloys than ferromanganese (e.g. ferrochrome, ferroboron, ferrotitanium and ferrovanadium) can be separated by corresponding reaction schemes. Where, as will normally be the case, the ferro alloy is solid, the leaching by bismuth relies on solid-state diffusion. Therefore, the smaller the particle size of the ferro alloy, the faster the leaching; hence powder is preferred, subject to its not being carried with the $BiM_n$ liquid into the next stage.

Negligible bismuth is carried over to the cathode, while the manganese or other metal is carried over at high current efficiency, to aluminium master alloys or the pure solid metals. In the case of the deposition of pure solid metals, this would occur on a planar electrode.

We claim:

1. A method of separating a ferro alloy, comprising leaching the alloy with a substance which alloys preferentially with a non-ferrous metal, a temperature being above the melting point of the preferentially formed alloy but below the melting point of iron, whereby the iron remains or precipitates as a solid.

2. A method according to claim 1, wherein the ferro alloy is a transition metal ferro alloy.

3. A method according to claim 1, wherein the ferro alloy is leached in powder form.

4. A method according to claim 1, wherein said substance is a liquid metal.

5. A method according to claim 4, wherein the liquid metal is bismuth.

6. A method according to claim 1, wherein the temperature is below the melting point of the ferro alloy, whereby after leaching the iron remains as s solid.

7. A method according to claim 1 further comprising the step of treating the molten preferentially formed non-ferrous alloy to isolate the said substance.

8. A method according to claim 7, wherein the treating step is by electrorefining.

9. A method according to claim 8, wherein the cathode of the electrowinning/electrorefining cell comprises an electronically conductive block in one face of which are formed channels of varying cross-section and direction.

10. A method according to claim 9, wherein the channels interconnect to form a network.

11. A method according to claim 9, wherein a molten metal stream at the cathode collects the refined metal.

12. A method according to claim 11, wherein the molten metal stream is aluminium, which collects refined manganese.

13. A method of refining a solute in bismuth or antimony, comprising making the molten solution anodic with respect to an electrowinning cathode separated from said solution by a diaphragm pervious to solute cations wherein the solute is titanium or manganese in bismuth.

14. A method according to claim 13 wherein the cathode of the electrowinning/electrorefining cell comprises an electronically conductive block in one face of which are formed channels of varying cross-section and direction.

15. A method of refining a solute in bismuth or antimony, comprising making the molten solution anodic with respect to an electrowinning cathode separated from said solution by a diaphragm pervious to solute cations wherein the solute is magnesium, chromium or vanadium in antimony.

16. A method according to claim 15 wherein the cathode of the electrowinning/electrorefining cell comprises an electronically conductive block in one face of which are formed channels of varying cross-section and direction.

* * * * *